US009183695B2

(12) United States Patent
Allen et al.

(10) Patent No.: US 9,183,695 B2
(45) Date of Patent: Nov. 10, 2015

(54) CREATING CASINO EXPERIENCES

(75) Inventors: Jeffrey L. Allen, Naperville, IL (US); Robert Bone, Las Vegas, NV (US); Joel R. Jaffe, Glenview, IL (US); Larry J. Pacey, Northbrook, IL (US); Eric M. Pryzby, Skokie, IL (US); Alfred Thomas, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 387 days.

(21) Appl. No.: 13/125,990

(22) PCT Filed: Oct. 30, 2009

(86) PCT No.: PCT/US2009/062741

§ 371 (c)(1),
(2), (4) Date: Apr. 26, 2011

(87) PCT Pub. No.: WO2010/051438

PCT Pub. Date: May 6, 2010

(65) Prior Publication Data

US 2011/0223993 A1 Sep. 15, 2011

Related U.S. Application Data

(60) Provisional application No. 61/110,350, filed on Oct. 31, 2008.

(51) Int. Cl.
*A63F 9/24* (2006.01)
*G07F 17/32* (2006.01)

(52) U.S. Cl.
CPC ..... *G07F 17/32* (2013.01); *G07F 17/3204* (2013.01); *G07F 17/3237* (2013.01);

(Continued)

(58) Field of Classification Search
CPC . G07F 17/32; G07F 17/3204; G07F 17/3237; G07F 17/3272; G07F 17/3274; G07F 17/3276
USPC ..... 463/25, 29–31, 34
See application file for complete search history.

(56) References Cited

U.S. PATENT DOCUMENTS 6,843,725 B2 1/2005 Nelson
2002/0123376 A1 * 9/2002 Walker et al. ..... 463/11

(Continued)

FOREIGN PATENT DOCUMENTS

WO WO2008030781 3/2008
WO WO2008118800 10/2008
WO WO2010051438 5/2010

OTHER PUBLICATIONS

"PCT Application No. PCT/US09/62741 International Preliminary Report on Patentability", Mar. 28, 2011 , 10 pages.

(Continued)

*Primary Examiner* — Lawrence Galka
(74) *Attorney, Agent, or Firm* — DeLizio Law, PLLC

(57) ABSTRACT

Techniques for controlling wagering game environments are described herein. In one embodiment, a computer-implemented method for controlling a casino wagering game environment includes determining a plurality of zones in the casino wagering game environment, wherein the zones include one or more wagering game machines. The method can also include presenting wagering games on the wagering game machines in the wagering game environment, and detecting an event in the wagering game environment, the event triggering a bonus game for which a plurality of players have a possibility of winning an award. The method can also include determining one or more of the zones in which to present media associated with the bonus game, and presenting, in the one or more zones, the media associated with the bonus game. The method can also include determining a winner of the bonus game, and providing the award to the winner.

18 Claims, 10 Drawing Sheets

(52) U.S. Cl.
CPC ..... *G07F17/3244* (2013.01); *G07F 17/3272* (2013.01); *G07F 17/3274* (2013.01); *G07F 17/3276* (2013.01)

(56) References Cited

U.S. PATENT DOCUMENTS

| | | | | |
|---|---|---|---|---|
| 2004/0204226 | A1* | 10/2004 | Foster et al. | 463/20 |
| 2004/0229685 | A1* | 11/2004 | Smith et al. | 463/29 |
| 2005/0043090 | A1 | 2/2005 | Pryzby et al. | |
| 2006/0009285 | A1 | 1/2006 | Pryzby et al. | |
| 2006/0046821 | A1* | 3/2006 | Kaminkow et al. | 463/16 |
| 2006/0143647 | A1* | 6/2006 | Bill | 725/10 |
| 2006/0252516 | A1* | 11/2006 | Walker et al. | 463/25 |
| 2006/0281543 | A1* | 12/2006 | Sutton et al. | 463/29 |
| 2006/0287043 | A1 | 12/2006 | Englman et al. | |
| 2007/0087810 | A1* | 4/2007 | Walker et al. | 463/16 |
| 2007/0155496 | A1 | 7/2007 | Okada | |
| 2008/0020827 | A1* | 1/2008 | Underdahl et al. | 463/25 |
| 2008/0032789 | A1 | 2/2008 | Walker et al. | |
| 2008/0076542 | A1* | 3/2008 | Iddings et al. | 463/27 |
| 2008/0076572 | A1 | 3/2008 | Nguyen et al. | |
| 2008/0102956 | A1 | 5/2008 | Burman et al. | |
| 2010/0304841 | A1* | 12/2010 | Sammon et al. | 463/25 |

OTHER PUBLICATIONS

"PCT Application No. PCT/US09/62741 International Search Report", Mar. 9, 2010 , 9 pages.

Wikipedia, "Walt Disney Imagineering", http://en.wikipedia.org/wiki/Walt_Disney_Imagineering Date Obtained from the Internet: Mar. 20, 2008 Last Date Modified: Mar. 9, 2008 , 11 pages.

* cited by examiner

CREATING CASINO EXPERIENCES

RELATED APPLICATIONS

This application claims the priority benefit of U.S. Provisional Application Ser. No. 61/110,350 filed Oct. 31, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

FIELD

Embodiments of the inventive subject matter relate generally to wagering game systems, and more particularly to wagering game systems that control media and other conditions in a wagering game environment.

BACKGROUND

Casinos typically offer wagering game machines, such as slot machines, video poker machines and the like. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd casino operators consequently strive to employ the most entertaining and exciting machines, features, and enhancements available because such machines attract frequent play and hence increase profitability to the operator. Therefore, there is a continuing need for wagering game machine manufacturers to continuously develop technologies that enhance the gaming experience and attract frequent play.

SUMMARY

Some embodiments include a computer-implemented method for controlling a casino wagering game environment. The method comprises determining a plurality of zones in the casino wagering game environment, wherein the zones include one or more wagering game machines; presenting wagering games on the wagering game machines in the wagering game environment; detecting an event in the wagering game environment, the event triggering a bonus game for which a plurality of players have a possibility of winning an award; determining one or more of the zones in which to present media associated with the bonus game; presenting, in the one or more zones, the media associated with the bonus game; determining a winner of the bonus game; and providing the award to the winner.

In some embodiments, at least one of the zones is defined by a contiguous floor area in the wagering game environment.

In some embodiments, at least one of the zones is defined by noncontiguous floor areas in the wagering game environment.

In some embodiments, the wagering game environment includes lighting devices, audio devices, and video projection devices to project light, sound, and video comprising the media associated with the bonus game.

In some embodiments, the casino wagering game environment includes cameras for recording player behavior, and wherein the bonus game trigger event arises from analysis of the recorded player behavior.

In some embodiments, the casino wagering game environment includes input devices for recording player activities, and wherein the winner is determined using the input devices.

In some embodiments, content of the wagering games is modified by the presenting the media associated with the bonus game.

Some embodiments include a system to present media and bonus games in a wagering game environment. The system comprises a plurality of wagering game machines configured to present wagering games; an account server configured to manage player accounts that provide monetary value for use in the wagering; a plurality of cameras and microphones configured to capture input associated with player activity in the wagering game environment, the plurality of cameras and microphones located about the wagering game environment; an environment server configured to receive the input; select, based on the input, media for presentation in the casino environment; and media presentation devices configured to present the media, wherein the media presentation devices are located about the wagering game environment.

In some embodiments, the environment server is further configured to analyze the input to determine a mood of players in the wagering game environment.

In some embodiments, the environment server is further configured to select, based on the input, a bonus game, and wherein the media includes game elements of the bonus game.

In some embodiments, the environmental server is further configured to determine zones in the wagering game environment, and select one or more of the zones in which the media will be presented.

In some embodiments, the environmental server is further configured to determine, based on the input, a mood of players in the wagering game environment, wherein the selection of media is based on the mood.

In some embodiments, the media presentation devices include one or more of pivoting lights, video projectors, adjustable wagering game machine stands, audio speakers, and video monitors.

Some embodiments include a method for presenting media in a casino. The method comprises capturing ambient sound in the casino; capturing video in the casino; determining, based on analyzing the ambient sound and video, player activities in the casino; receiving information about wager transactions associated with wagering games presented on wagering game machines residing in the casino; determining, based on the player activities and information about wager transactions, a mood in the casino; selecting media consistent with the mood in the casino; and presenting the media in the casino.

In some embodiments, the presenting includes adjusting pivoting lights to illuminate certain parts of the casino, and selecting intensity of light emanating from the pivoting lights.

In some embodiments, the method further comprises determining a plurality of the zones in the casino, wherein the ambient sound and video are captured from one of the zones, and wherein the mood is associated with the one of the zones, and wherein the media is presented in the one of the zones.

In some embodiments, the method further comprises determining a plurality of the zones in the casino, wherein the ambient sound and video are associated with the zones; determining, based on the ambient sound and video, other moods in the casino, wherein each of the other moods is associated with one of the zones; and presenting other media in the zones, wherein the media in each of the zones is consistent with the mood associated with the zone.

Some embodiments include a machine-readable medium which when executed by a machine causes the machine to execute instructions comprising instructions to create zones associated with geographic areas in a casino; instructions to capture sound and video images in at least one of the zones, wherein the sound and images represent player activities in the at least one of the zones; instructions to analyze the sound and video images to determine a mood for the at least one of the zones; instructions to select media consistent with the mood; instructions to present the media in the at least one of the zones, wherein the instructions to present the media include instructions to project video images onto reflective material positioned so the images are not perceptible outside the at least one of the zones, and instructions to present audio over speakers configured so the audio is not perceptible outside the at least one of the zones.

In some embodiments, the machine-readable medium further comprises instructions to request greater hospitality services for the at least one of the zones.

In some embodiments, the reflective material includes triangular shapes, and wherein the reflective material is suspended from a ceiling of the casino.

In some embodiments, an apparatus comprises means for selecting media for presentation in a wagering game environment, wherein the media is coordinated to set a mood in the wagering game environment; means for projecting the media in one or more zones of a wagering game environment, wherein the media is not significantly perceptible outside the one or more zones; and means for determining that players in the wagering game environment are exhibiting behavior indicative of the mood.

In some embodiments, the determining that players in the wagering game environment are exhibiting behavior indicative of the mood are further configured is based on perception of player movements and player noises in the wagering game environment.

In some embodiments, the media constitutes a bonus game, and wherein selecting media for presentation is based on detection that one or more players in the wagering game environment are eligible to participate in the bonus game.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into five sections. The first section provides an introduction to embodiments of the invention, while the second section describes example wagering game machine architectures. The third section describes how some embodiments present media, while the fourth section describes operations of some embodiments. The fifth section presents some general comments.

Introduction

This section provides an introduction to some embodiments of the invention. In some embodiments, the inventive subject matter includes a system that can detect a mood of players in a casino and present media tailored to the mood. For example, if the system determines players are in a mellow mood, a media show in the casino may include soft music, dim lighting, and soothing video mages (e.g., images of beautiful landscapes). However, if the system detects an excited mood, the media may include up-tempo music, bright lighting, and exciting video images (e.g., sports highlights). Alternatively, the system may create or modify casino moods based on information about past dates, seasonal events, etc. For example, because historic data indicates that moods are typically excited on certain days (e.g., Sundays during football season), the system may present up-tempo media on those days. Thus, some embodiments can select media for a mood without first detecting moods.

In other embodiments, the system uses various media to present community bonus games in the casino. For example, the system may present a community bonus game by projecting video images onto casino walls, playing sound effects through overhead speakers, and manipulating casino lighting. In some instances, the system presents the media shows in a manner that limits who can perceive the shows. For example, the system may project lighting, audio, and video in a manner that is perceptible from only a certain perspective or from a certain geographic area.

In yet other embodiments, the system can divide a casino into zones, where the system presents a different media show in each zone. Thus, the casino can offer a variety of media shows, supporting a plurality of bonus games and moods.

Although this section describes some embodiments, the following sections describe many other features and embodiments.

Network and Machine Architectures

This section describes an example operating environment and presents structural aspects of some embodiments. This section includes discussion about wagering game machine architectures, wagering game networks, and components for selecting and presenting media in casinos.

Figure 1:
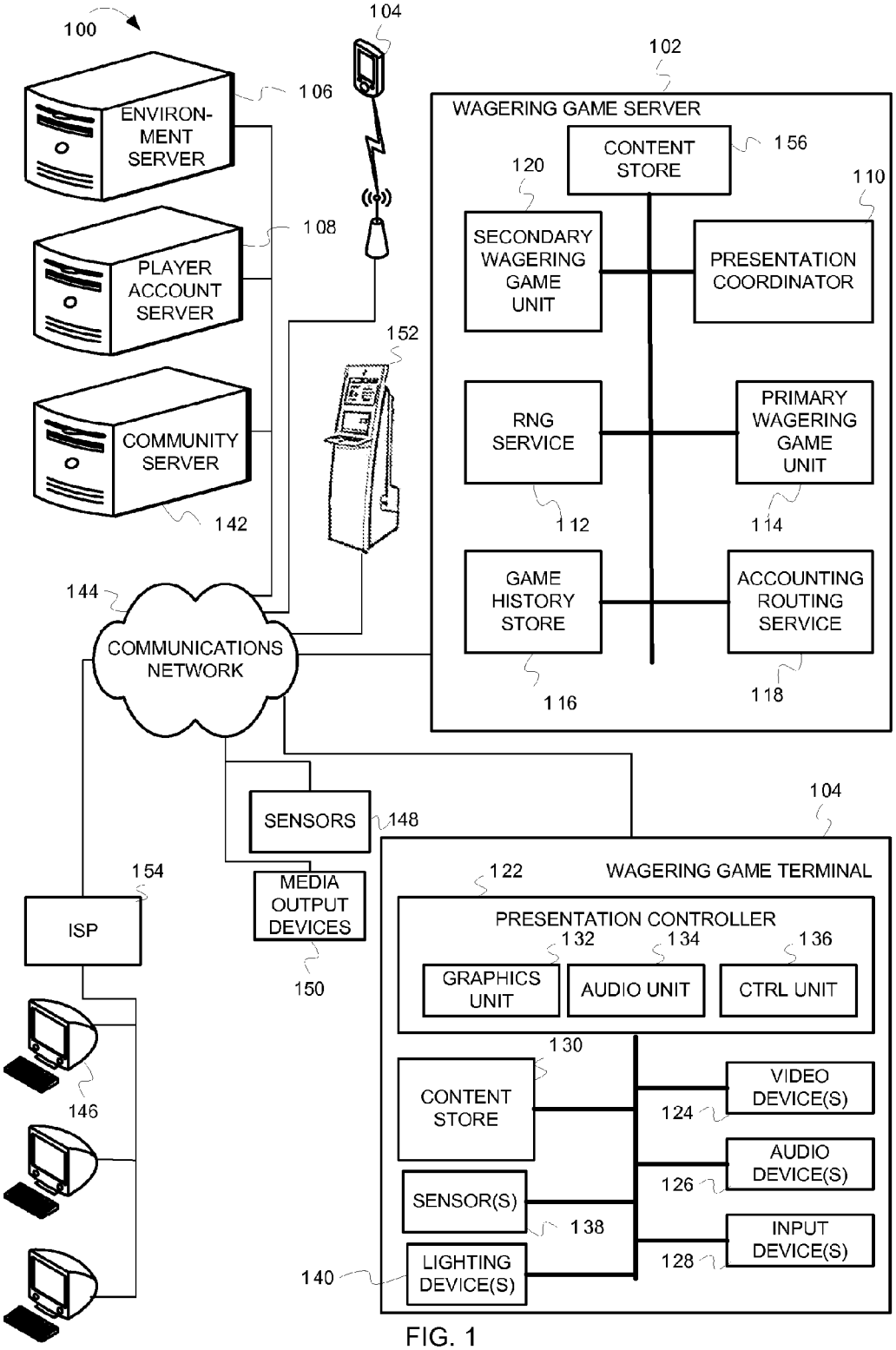
FIG. 1 is a conceptual diagram of a wagering game network, according to some embodiments of the invention.

FIG. 1 is a conceptual diagram of a wagering game network, according to some embodiments of the invention. The wagering game network 100 includes a communications network 144 connected to an environment server 106, sensors 148, media presentation devices 150, player account server 108, community server 142, kiosk 152, wagering game server 102 and wagering game terminal 104. The communications network 144 is also connected to an internet service provider (ISP) 154, which is connected to community terminals 146. In some embodiments, all but the ISP 154 and community terminals 146 are located in a casino.

The communications network 144 can include wired and wireless communication links that employ any suitable connection technology, such as Bluetooth, 802.11, Ethernet, public switched telephone networks, SONET, etc. In some embodiments, the wagering game network 100 can include any number of the components shown in FIG. 1 (e.g., the network 100 can include 20, 100, or 1000 wagering game terminals). In some embodiments, some of the components are located in a casino or other wagering game environment.

The environment server 106 can welcome patrons in casinos, determine moods of casino patrons, control media shows, present community bonus games, and more (see below). For example, the environment server 106 can detect that patrons have arrived in a casino (e.g., by receiving information from a hotel check-in desk, sensing a patron's RFID tag, receiving information from a player's mobile phone, etc.) and present media welcoming the patrons. Also, the environment server 106 can analyze input from the sensors 148 and other devices (e.g., player account server 108) to determine moods of patrons. For example, the environment server 106 may analyze captured video of player movements and infer a mood (e.g., high-energy, mellow, etc.) in the casino. The environment server 106 can present media consistent with the mood, or it can alter the mood by presenting media inconsistent with the mood.

In some embodiments, the environment server 106 can divide a casino environment into different zones. In turn, the environment server 106 can localize media shows, mood analysis, and other operations to the different zones in a casino environment. In some instances, the server 106 may present media that is perceptible in certain zones, but imperceptible in others. Furthermore, the server 106 may present media that is best perceived from a particular perspective.

The sensors 148 can include video capture devices (e.g., cameras), audio capture devices (e.g., microphones), movement sensing devices (e.g., weight sensors, lasers, etc.), thermometers, and other devices suitable for sensing activity and conditions in a casino or other wagering game environment. The sensors 148 can provide input to the environment server 106 and other devices of the wagering game network 100. The sensors 148 can be distributed throughout a casino or other wagering game environment.

The media presentation devices 150 can include lighting devices, lasers, video projectors, video monitors, audio speakers, projection media, and any other suitable media output device. The lighting devices can include light emitting diodes, incandescent lights, fluorescent lights, halogen lights, etc. The media presentation devices 150 can be distributed throughout a casino or other wagering game environment.

The wagering game server 102 can determine results of wagering games and communicate the results to wagering game terminals 104 and other devices. In some embodiments, the wagering game server includes a presentation coordinator 110, random number generator service 112, game history store 116, content store 156, and accounting routing service 118. The presentation coordinator 110 can configure, launch, and terminate primary wagering game units and secondary wagering game units. The presentation coordinator 110 can also maintain a list of all terminals with which it interacts.

The primary wagering game unit 114 can offer a plurality of primary wagering game types (e.g., slots, poker, roulette, etc.) and themes (e.g., a movie theme, cartoon theme, etc.). The secondary wagering game unit 120 can offer a plurality of secondary wagering games (a.k.a. bonus games). In some embodiments, secondary games are triggered by events in primary games. Alternatively, secondary games may be triggered by events independent of any primary game. For example, players can buy into a secondary game in which one randomly selected player wins a progressive jackpot irrespective of any primary game. The primary and secondary wagering game units 114 & 120 can reside on the same server or they can reside on different servers. That is, the wagering game network 100 can include multiple wagering game servers 102 that work together or separately.

The presentation coordinator 110 can maintain a list of all active terminals. The primary and secondary wagering game units 114 & 120 can host wagering games and receive player input from the terminal 104. When hosting wagering games, the primary and secondary wagering game units 114 & 120 can use the random number generator service 112 to determine wagering game results. The primary and secondary wagering game units 114 & 120 can send control information to the terminal 104, where the control information indicates results for the wagering games. For example, the control information can instruct the terminal 104 to present a specific outcome for a wagering game (e.g., a certain reel combination for a slots game). The primary and secondary wagering game units 114 & 120 can also send content (from content store 156) to the terminal 104. In turn, the terminal 104 can present content indicting the results. The content can be locally stored or received from the server 102. In some embodiments, control information can instruct the terminal 104 to present other types of content, such as advertising, attract modes, player messages, hotel information, etc. The control information can be in any format understood by the terminal 104.

The server 102 also includes an accounting routing service 118, which can distribute wagering game information (e.g., wager amounts, winning awards, etc.) between primary and secondary wagering game units 114 & 120, an account server (not shown), and other components of the wagering game system 100.

The terminal 104 can act as a smart client device capable of transmitting player input to the server 102, processing control information, and rendering wagering game content. The terminal 104 includes a content store 130 and a presentation controller 122. The presentation controller 122 includes a control unit 136, graphics unit 132, and audio unit 134. The control unit 136 can process control information and request operations from the other components. In response to the control information, the graphics and audio units 132 & 134 can present content from the content store 130. For example, if the control information instructs the terminal 104 to present a specific game result, the graphics and audio units 132 & 134 present the game result using audio and graphic content in the content store 130. The control information can instruct the presentation controller 122 to present any type of information, such as game results, player messages, attract modes, advertising, hotel information, etc.

The presentation controller's graphics and audio units 132 & 134 can include audio codecs, video codecs, graphics processing engines, physics engines, and any other devices suitable for presenting audio and video content. The content store 130 can include animation data, game art (e.g., JPEG files, PCX files, etc.), audio content (e.g., MP3 files, WAV files, etc.), prerecorded video (e.g., MPEG files, AVI files, etc.), text, metadata (e.g., audio & video configuration data), etc.

Although the operations for presenting wagering games can be divided between a wagering game server and a wagering game terminal, the operations can be performed exclusively by a wagering game machine. Conversely, the operations can be even further subdivided where several devices (i.e., not just a wagering game server and terminal) perform operations for presenting wagering games. Furthermore, any component involved in presenting wagering games can communicate and interact with the environment server 108 and other devices of the wagering game network 100.

The community server 142 can provide a wide range of services to members of virtual gaming communities. For example, the community servers may allow players to:

- Create Social Networks—When creating social networks, members can create electronic associations that inform network members when selected members are: 1) online, 2) performing activities, 3) reaching milestones, 4) etc.
- Establish a Reputation—Community members can establish reputations based on feedback from other community members, based on accomplishments in the community, based on who is in their social network, etc.
- Provide Content—Community members can provide content by uploading media, designing wagering games, maintaining blogs, etc.
- Filter Content—Community members can filter content by rating content, commenting on content, or otherwise distinguishing content.
- Interact with Other Members—Community members can interact via newsgroups, e-mail, discussion boards, instant messaging, etc.
- Participate in Community Activities—Community members can participate in community activities, such as multi-player games, interactive meetings, discussion groups, real-life meetings, etc.
- Connect Casino Players to Online Members—Community members who are playing in casinos can interact with members who are online. For example, online members may be able to: see activities of social contacts in the casino, chat with casino players, participate in community games involving casino players, etc.

In some embodiments, the environment server 106 publishes information to the community server 142. The information can include player activities, moods, player accomplishments, or any other information known to the environment server. In turn, the community server can publish the information to community members and others via blogs, websites, emails, web services, etc.

The community terminals 146 enable community members to access virtual gaming communities and other services available from the community server 142 and other network components. The community terminals 146 can be personal computers, workstations, personal digital assistants, or other computing devices. In some embodiments, the community terminals 146 can wirelessly connect to the ISP 154. As noted above, in some embodiments the community terminals are located outside casinos, enabling players and community members to access online communities from outside casinos.

The player account server 108 can maintain player financial accounts and facilitate account transactions. For example, players can transfer funds to the account server 108 (e.g., from a bank, kiosk, etc.), whereby the funds will be available for use playing wagering games. In some embodiments, the funds are available for non-gaming use, such as for purchasing online products and services. Thus, players can transfer funds from player accounts to game session accounts available on the wagering game terminals 104. Upon terminating gaming sessions, players can transfer any remaining funds back to the player accounts. The account server 108 can keep detailed records of all transactions.

Players can use the kiosk 152 to update player account information, perform account transactions, access online community information, etc. Thus, the kiosk 152 can exchange information with the servers 106, 108, &142, and other components of the wagering game network 100.

In some embodiments, components of the wagering game network 100 can subscribe to receive notice of various events. As events occur, components can publish messages to subscribers. For example, the environment server 106 can subscribe to receive notice that one or more of the sensors 148 detected presence of people. As the sensors 148 detect people, they can publish messages to the environment server and other subscribers. As another example, the environment server 106 can subscribe to receive notice of events in online communities, where the community server 142 publishes messages when the events occur. In some embodiments, the environment server 106 may present media and perform other operations in response to certain events. Thus, the environment server 106 and other components can use messaging to facilitate media presentations, community bonus games, mood determination, and more. In some embodiments, the messages can have priorities, so components can determine which messages to process first.

Any component of the wagering game network 100 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 2:
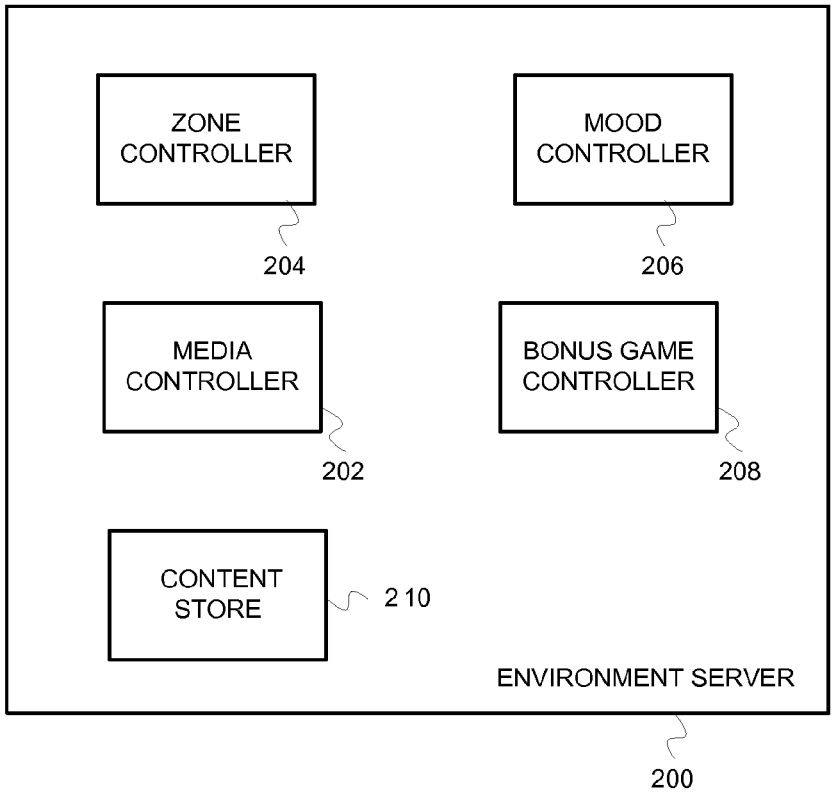
FIG. 2 is a block diagram illustrating components of an environment controller, according to some embodiments of the invention.

While FIG. 1 shows the various components of a wagering game network, FIG. 2 shows more details about some embodiments of an environment controller.

FIG. 2 is a block diagram illustrating components of an environment server, according to some embodiments of the invention. As shown, the environment server 200 includes a zone controller 204, a media controller 202, mood controller 206, and bonus game controller 208.

The zone controller 204 can divide a casino or other wagering game environment into geographical or logical zones. Other components in the environment server 200 can use information about the zones to facilitate various affects, such as limiting media presentations to different zones, processing mood information from particular zones, summoning additional hospitality services in certain zones, etc. In some embodiments, the zone controller 204 includes information about audio and visual perspectives around a casino. For example, the zone controller 204 may include information indicating what players may perceive at each gaming terminal in a casino. Such information can be used to create media shows perceptible from certain locations in a casino. In some embodiments, the information may enumerate all wagering terminals with a direct line of sight to a particular projector screen, overhead sign, video monitor, etc.

The mood controller 206 can process input from sensors disposed throughout a casino. The input can include audio, video, motion sensor feedback, temperature feedback, etc. The mood controller 206 can process (e.g., computer vision analysis, audio analysis, movement analysis, etc.) the input to determine a mood of players in the casino. Other components can use information about mood to select and control media in the casino. In some instances, components can alter moods by presenting different media at certain locations in a casino. For example, if the mood controller 206 indicates a low-energy mood in proximity to a high-traffic area in the casino, the environment server 200 may present selected media to elicit a high-energy mood in the high-traffic area.

The bonus game controller 208 can launch and control individual and community bonus games in a casino. In some instances, the bonus game controller 208 receives and processes input from sensors disposed throughout the casino. The sensor input or other events can trigger a community bonus game. The bonus controller 208 can determine results for the bonus game, and it can select media for presenting the results.

The media controller 202 controls media presentations in a casino. For example, the media controller 202 can present media by activating pivoting lights, strobe lights, video devices, etc. The media may include content that welcomes players to a casino, indicates bonus game results, enhances or alters moods, etc. In some instances, the media controller 202 selects media based on output from the zone controller 204, mood controller 206, and/or bonus game controller 208.

Any component of the environment server 200 can use content stored in the content store 210. For example, the media controller 202 can present audio and video from the content store 210.

Presenting Media and Detecting Player Activities

Figure 3:
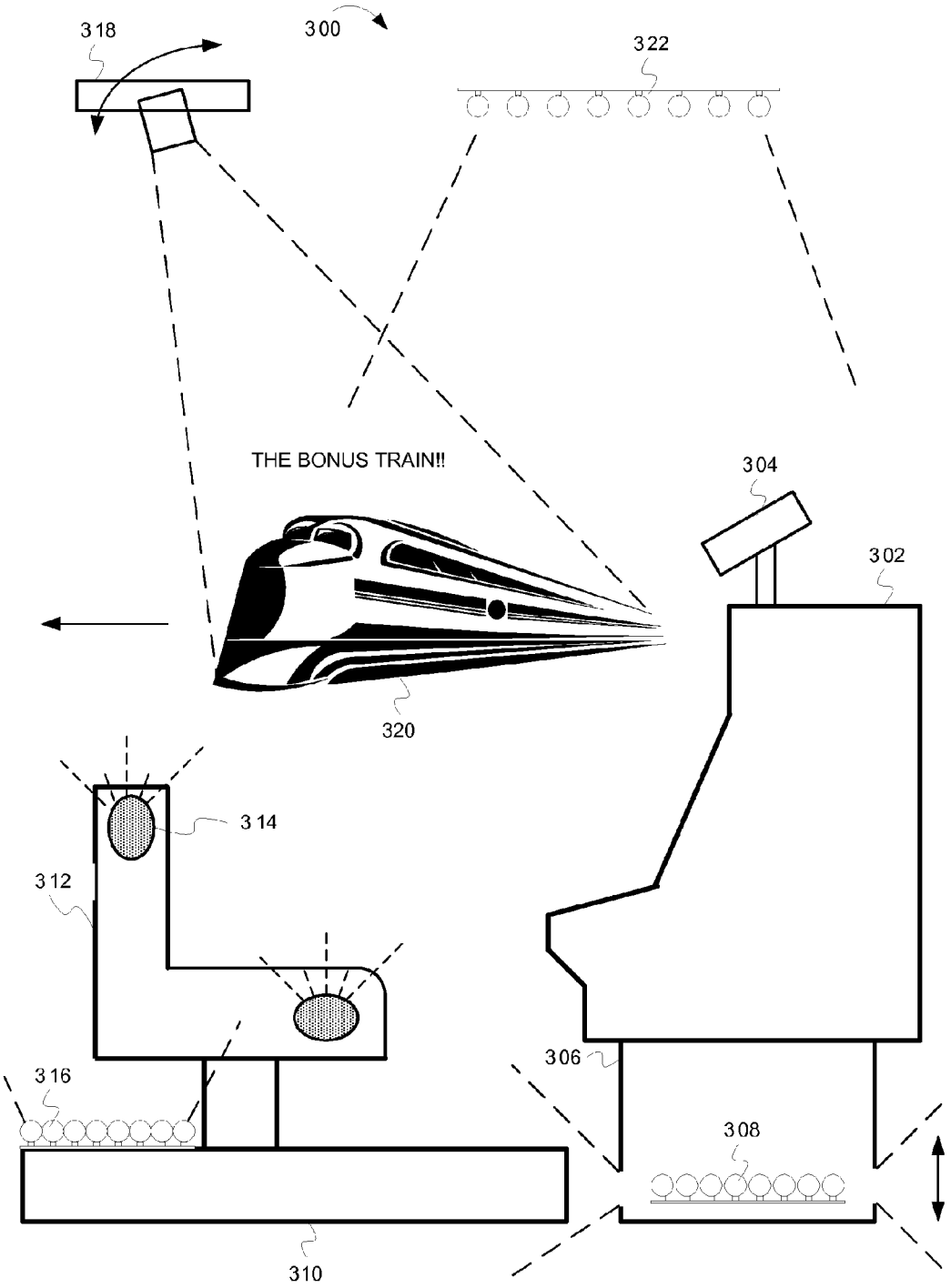
FIG. 3 is a conceptual diagram illustrating a media presentation in a wagering game environment, according to some embodiments of the invention.

FIG. 3 is a conceptual diagram illustrating a media presentation in a wagering game environment, according to some embodiments of the invention. As shown, a wagering game environment 300 can include various media presentation devices, such as a video projector 318, light bars 322, 316, & 308, audio speakers 314, and an adjustable wagering game machine stand 306. Although not shown in FIG. 3, other embodiments can include other media presentation devices, such as lasers, pivoting lights, strobe lights, video monitors, fog machines, aroma devices, etc.

In FIG. 3, the wagering game environment 300 also includes a wagering game terminal 302 on which a camera 304 is mounted. Additionally, there is a chair 312 (including the speakers 314 and a light bar 316) mounted on a platform 310 which is positioned in front of the wagering game terminal 302. The light bars 316 on the platform 310 can create various lighting effects about a player. Also, the adjustable wagering game machine stand 306 can emit varying lighting effects. For example, the stand 306 can open or close a window, allowing more or less light through the window. Alternatively, the entire stand 306 may rise/lower, allowing more/less light through a cutout. In some embodiments, an environment server, wagering game server, or the wagering game terminal can control the light bars to modify lighting around the terminal 302 and about the casino.

In FIG. 3, the media presentation devices are presenting media in the wagering game environment 300. For example, the video projector 318 is projecting an image of a train 320 on a wall in the wagering game environment 300. Additionally, the light bars 322, 316, & 308 are presenting light and the speakers 314 are presenting sound. In some embodiments, one or more of the media presentation devices present a coordinated media show.

In some embodiments, the media presentation devices are connected to and controlled by an environment server (not shown in FIG. 3). For example, the video projector 318 may present video content received from an environment server. Alternatively, the video projector 318 (or other device) may receive a signal from the environment server to present content included in the video projector 318.

In some embodiments, media presentations are associated with community bonus games. In such an embodiment, an environment server may detect player activities and/or attributes in the environment 300, where the activities and/or attributes trigger a community bonus game. For example, an environment server may detect (e.g., via video analysis) a player wearing a shirt of a certain color. In response, the environment server may launch a bonus game in which certain players (e.g., players with shirts of the same color) are eligible to win an award. After determining a winner, the environment server can present results for the bonus game by presenting media in the environment 300. In presenting results, the video projector may present the bonus train 320. In some instances, the bonus train 320 (or other video content) can move about the environment 300, as a plurality of projectors alternate projection of the train 320. The environment server may also employ other media presentation devices to present media as part of the bonus game. In some embodiments, the environment server can present graphics on wagering game terminals (e.g., on primary video monitors or top boxes) as part of the media presentation. For example, when presenting the train 320, the environment server can present graphics on a display monitor in the wagering game terminal 302. The graphics may be integrated with graphics associated with other base games or bonus games.

In some embodiments, as part of a bonus game (or just for entertainment), an environment server can acquire a player's avatar from a community server. In turn, the environment server can project the avatar on a wall (e.g., instead of the train 320). A player can interact with the avatar or other graphics appearing on the wall. In some embodiments, the wall could be constructed of rear projection material through which infrared light can pass. Infrared sensors can detect infrared signals from behind the projection, so the environment server can identify players wearing infrared identifiers. After the environment server identifies a player, the environment server can use the infrared sensors (or video analysis, etc.) to detect the player's gestures, movements, etc. In turn, the environment server makes the avatar interact with the player.

In some embodiments, as part of a wagering game and/or wagering game celebration, the environmental server can present (e.g., using the projector 318 or other presentation devices) media including images of a player. For example, the camera 304 or other video capture devices can record video of a player playing a wagering game, celebrating a jackpot, or otherwise interacting with wagering game machines and players. The environment server can insert images of the player into scenes designed to celebrate jackpots and other game events. In some instances, the environment server can analyze the captured images to detect a player's movements and gestures. In turn, the environment server can present the player's avatar performing the player's movements and gestures.

Environment servers can present media for: welcoming players into a casino; recognizing a group of social contacts from an online community; recognizing player achievements, such as when players win big jackpots, achieve certain statuses (e.g., high-roller status), accomplish rare feats (e.g., winning with a royal flush in video poker); etc. In some instances, the environment server can determine what a player is trying to achieve (e.g., a royal flush), and notify the player when others reach that achievement. In some instances, the media are presented in ways that are perceivable by table game players, players in a sports book, etc.

Figure 4:
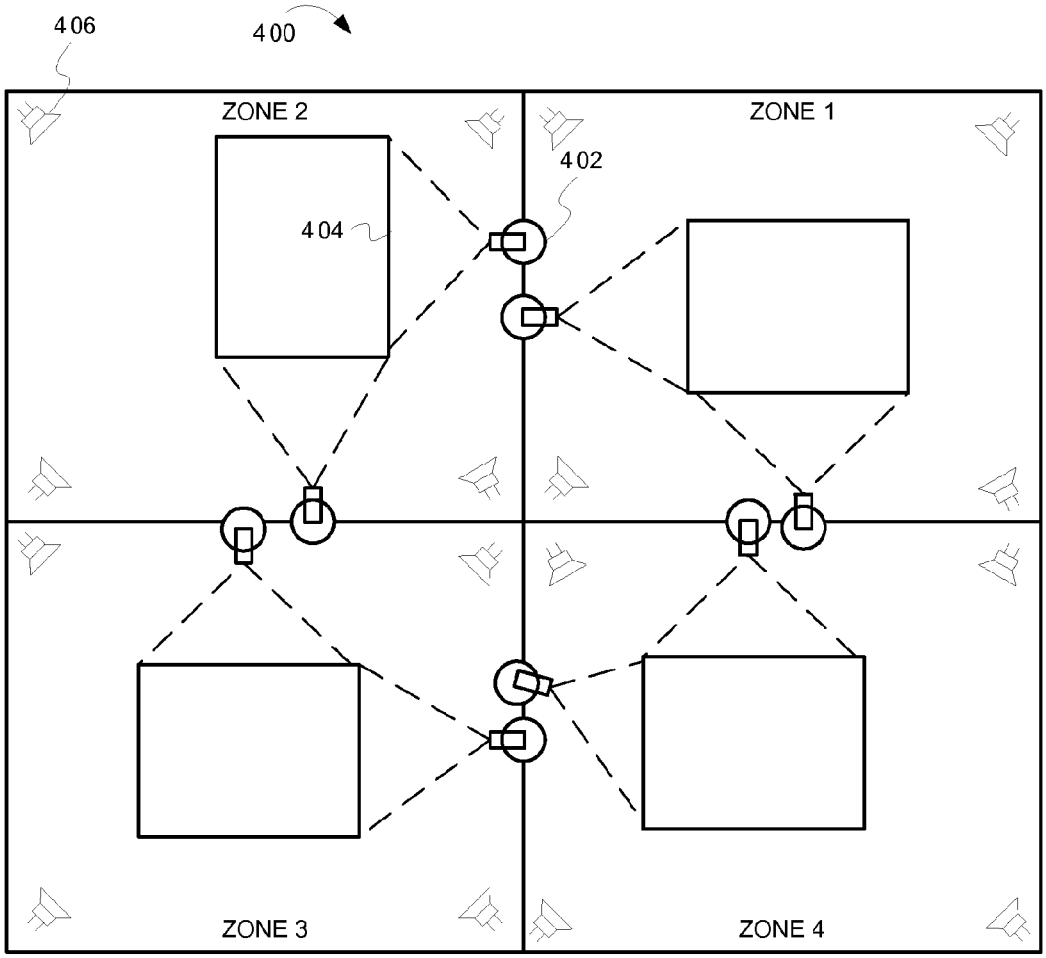
FIG. 4 is a conceptual diagram illustrating zones in a wagering game environment, according to some embodiments of the invention.

As noted above, some embodiments of an environmental server can divide a wagering game environment into zones. FIG. 4 is a conceptual diagram illustrating zones in a wagering game environment, according to some embodiments of the invention. In FIG. 4, a wagering game environment 400 (e.g., casino) is geographically divided into four zones, resembling quadrants of a Cartesian coordinate system. In FIG. 4, zone 1 occupies the upper right quadrant, zone 2 occupies the upper left quadrant, zone 3 occupies the lower left quadrant, and zone 4 occupies the lower right quadrant. Each zone includes speakers 406, video projectors 402, and projection screens 404. Although not shown, the zones can take any suitable shape and include any suitable media presentation devices. The speakers 406, video projectors 402, and other devices can be connected (directly or indirectly) to an environment server.

In some embodiments, an environment server may present media in one zone, where the media is for players in another zone. For example, an environmental server may instruct the video projector 402 to project video content on the projection screen 404 in zone 2. The projection screen 404 may be positioned high overhead, where players in zone 2 cannot readily see video content appearing on the screen 404. However, players in zone 1 may be able to clearly see the video content. In some instances, an environment server's zone controller includes information about perspectives from which players can perceive media. Thus, some environment servers can select media presentation devices that will provide media perceptible in particular zones.

In yet other embodiments, some environment servers can create "virtual zones." Virtual zones may include all wagering game terminals at which members of a social network are playing. Using information about what media is perceptible from the terminals, the environment server can present a media show perceptible by all the social network members, even though the members are at disparate geographic locations.

In some embodiments, the video projectors can pivot, projecting video on various surfaces in the wagering game environment 400. Similarly, the audio speakers 406 and other media presentation devices may also pivot and move.

Figure 5:
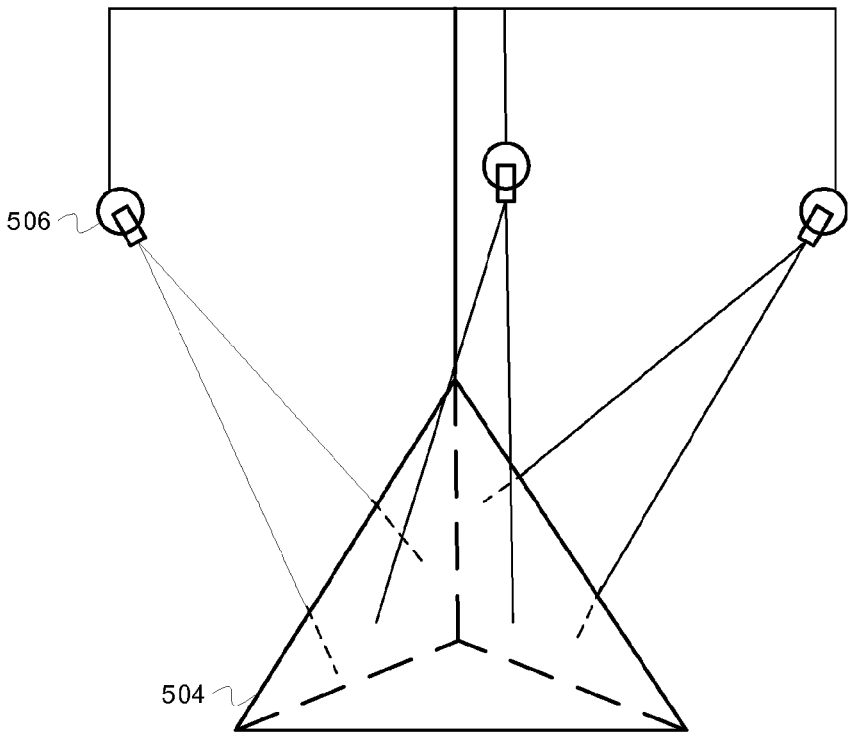
FIG. 5 is a conceptual diagram illustrating a projection screen arranged as a triangular pyramid, according to some embodiments of the invention.

The projection screens can move and may be made of any material suitable for displaying high-resolution video content from video projectors or other devices. In some instances, projection screens can be arranged in different shapes to facilitate different perspectives. FIG. 5 is a conceptual diagram illustrating a projection screen arranged as a triangular pyramid, according to some embodiments of the invention. In FIG. 5, video projectors 506 can project video content on three sides of the projection screen 504. Similarly, lights can illuminate different surfaces of the screen 504, as lighting features of a media show. The projection screen 504 can be arranged in any suitable shape and can hang from ceilings or other overhead mountings. The screens 504 can also mount on wagering game machines and other floor-level devices. In some instances, the screens are configured as two-dimensional shapes, such as triangles, squares, octagons, etc.

In some embodiments, an environment server may utilize each surface of the projection screen 504 to present different media content. In other instances, a single projector can project a single image onto all sides of the screen 504 (i.e., each side of the screen can show part of the image). In yet other instances, projectors can utilize the bottom side of the screen 504. The screen 504 may reside in one zone, while media content appearing on the screen may be best viewed in a different zone.

Figure 6:
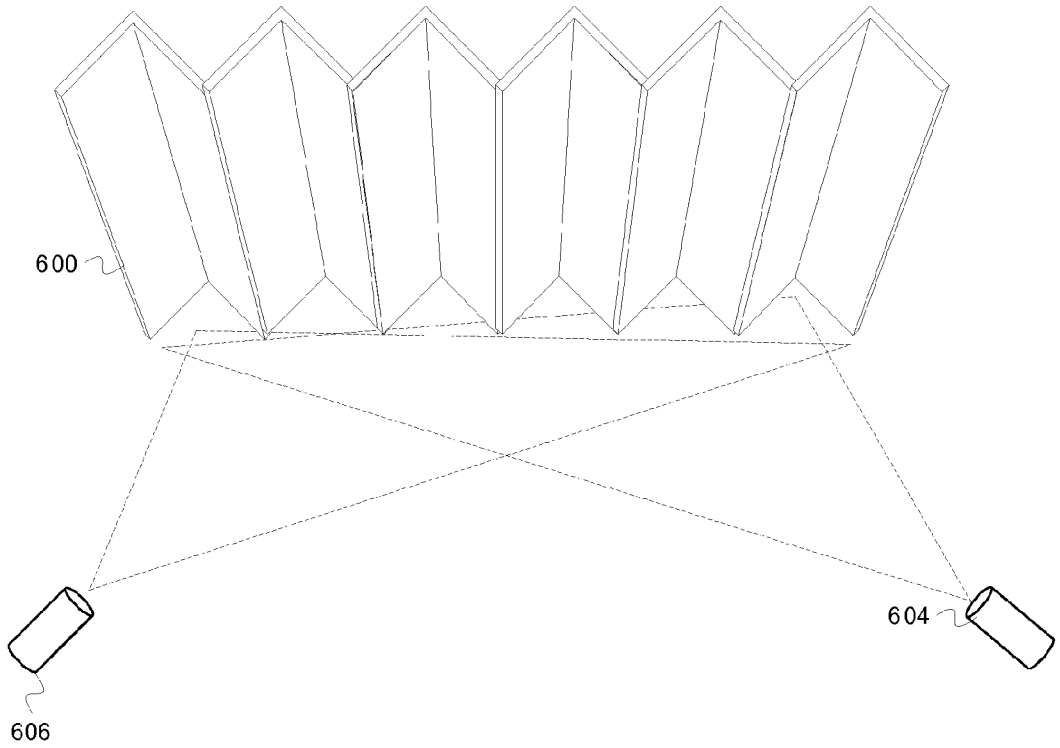
FIG. 6 is a conceptual diagram illustrating a bi-fold projection screen, according to some embodiments of the invention.

FIG. 6 is a conceptual diagram illustrating a bi-fold projection screen, according to some embodiments of the invention. As shown, a bi-fold projection screen 600 can display video content from two different video projectors 604 & 606. The bi-fold projection screen 600 can reside on a ceiling, walls, or any other suitable location in a casino environment.

In some embodiments, projection screens may be arranged throughout a wagering game environment such that certain lighting and video effects are perceptible from only certain perspectives. For example, a plurality of projection screens may be arranged to reflect light to a particular location on a casino floor, such as where a player stands to play a certain wagering game machine. Thus, media appearing on the plurality of projection screens may be best viewed by a particular player at a particular machine. The media may be imperceptible or unintelligible to players at other locations in the casino. As a result, an environment server can create localized media presentations. In some instances, the environment server may tailor such a localized media show to a particular player's liking.

In some embodiments, the projection screens can be made from stretch fabrics that can be applied to various shapes. For example, a screen could stretched to fit a volcano-shaped solid. The environment server could project video representing a lava flow onto or from the underside of the screen.

For additional lighting effects, some embodiments include adjustable (e.g. pivoting, rotating, etc.) three-dimensional (e.g., spherical, cubic, etc.) lighting units in which lights are recessed into cavities, so light is visible from only certain perspectives. A plurality of the three-dimensional work together to form a larger lighting unit. An environment server and other devices can control such lighting units.

Figure 7:
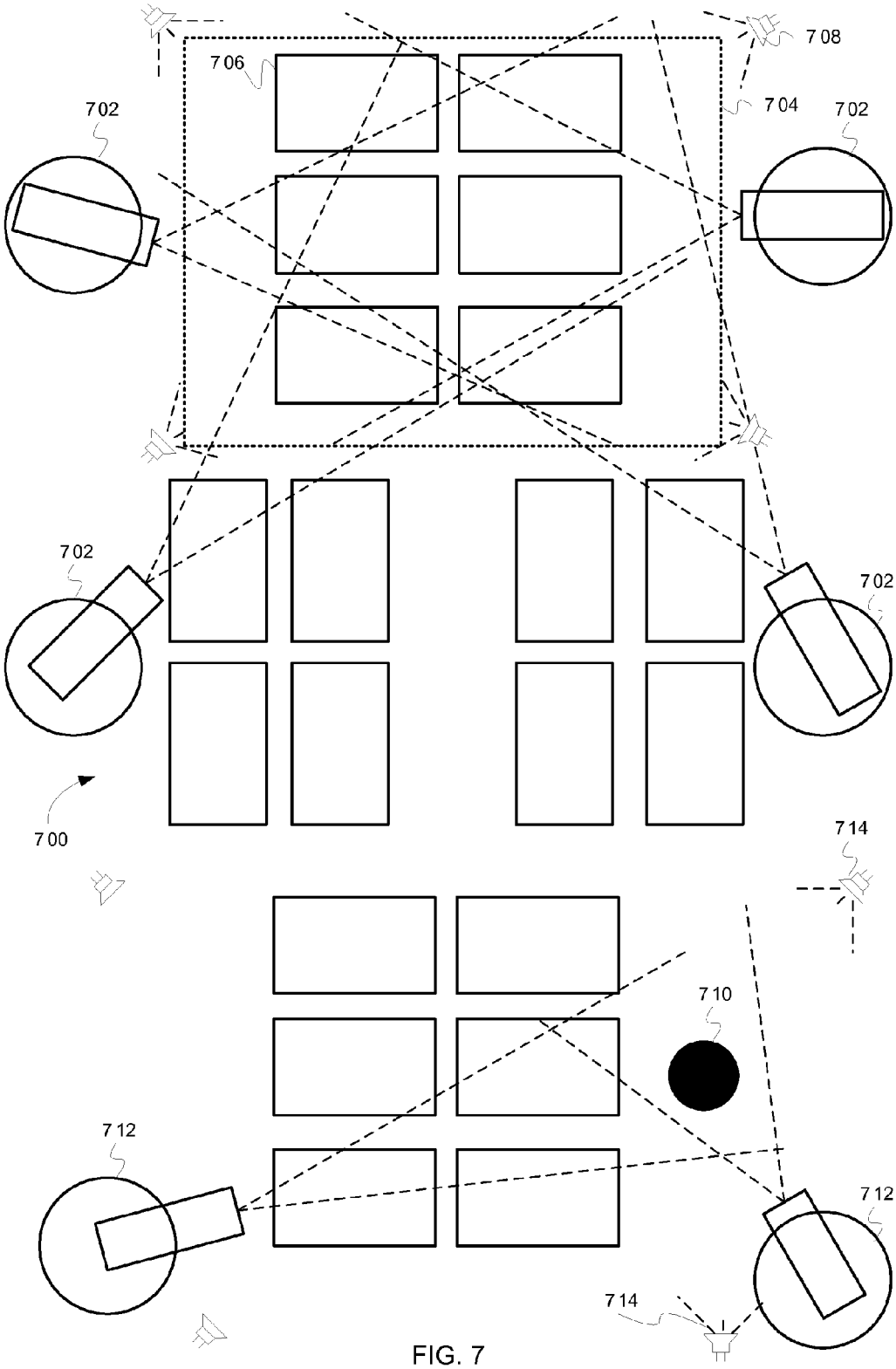
FIG. 7 is a conceptual diagram illustrating an ad hoc VIP section on a casino floor, according to some embodiments of the invention.

Casinos can utilize environment servers for more than just presenting media. In some embodiments, environment servers can create ad hoc VIP sections on a casino floor. The VIP sections may offer enhanced hospitality services, high-limit betting, special VIP gaming options, etc. In some instances, environment servers can summon additional hospitality staff, invite players to the VIP area, and enable high-limit betting and other VIP gaming options. As a result, environment servers may interact with wagering game servers, hospitality servers, player account servers, etc. In addition to the VIP services, environment servers may use media to create a mood in an ad hoc VIP section. FIG. 7 is a conceptual diagram illustrating an ad hoc VIP section on a casino floor, according to some embodiments of the invention. In FIG. 7, an environment server configures pivoting lights 702 to illuminate a VIP section 704 on a casino floor 700. Additionally, the environment server may play selected music (via speakers 708) in the VIP section 704. In the VIP section 704, the wagering game machines 706 may be configured for high denominations, high betting limits, or other settings not available outside the VIP section. Although not shown in FIG. 7, additional hospitality staff may be deployed to the VIP section 704.

In some instances, the wagering game machines 706 are configured to allow only certain players to play (e.g., high rollers, special winners, etc.). The lighting and other media, augmented hospitality services, and high-limit gambling in the VIP section 704 make it a focal point of the casino floor 700.

FIG. 7 also shows how some media may be programmed to follow a media beacon 710 about the casino floor 700. That is, media presentation devices can present media that can be perceived from the location of the media beacon 710. In some instances, casino operators, players, or machines may move beacons around the casino floor. The beacon 710 can indicate its position using radio frequency signals, infrared signals, or any other suitable signaling technology. In some embodiments, the beacons can be people or other objects (e.g., shirts, hats, mobile phones, etc.). Some environment servers can locate the people or objects using computer vision, signals from the objects, or other suitable techniques.

As shown, the lights 714 and speakers 716 project media toward the media beacon 710. In some cases, media presentation devices far away from a beacon may present media that is perceptible from the beacon's location (e.g., video on an overhead sign across the casino). In some embodiments, media for a community bonus game or other gaming events may follow the media beacon 710. For example, a video image, such as the bonus train noted above, may follow the beacon 710 about the casino 700.

Operations

This section describes some example operations associated with some embodiments of the invention. In the discussion below, the flow diagrams will be described with reference to the diagrams presented above. However, in some embodiments, the operations can be performed by logic not described in the above-described diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 8:
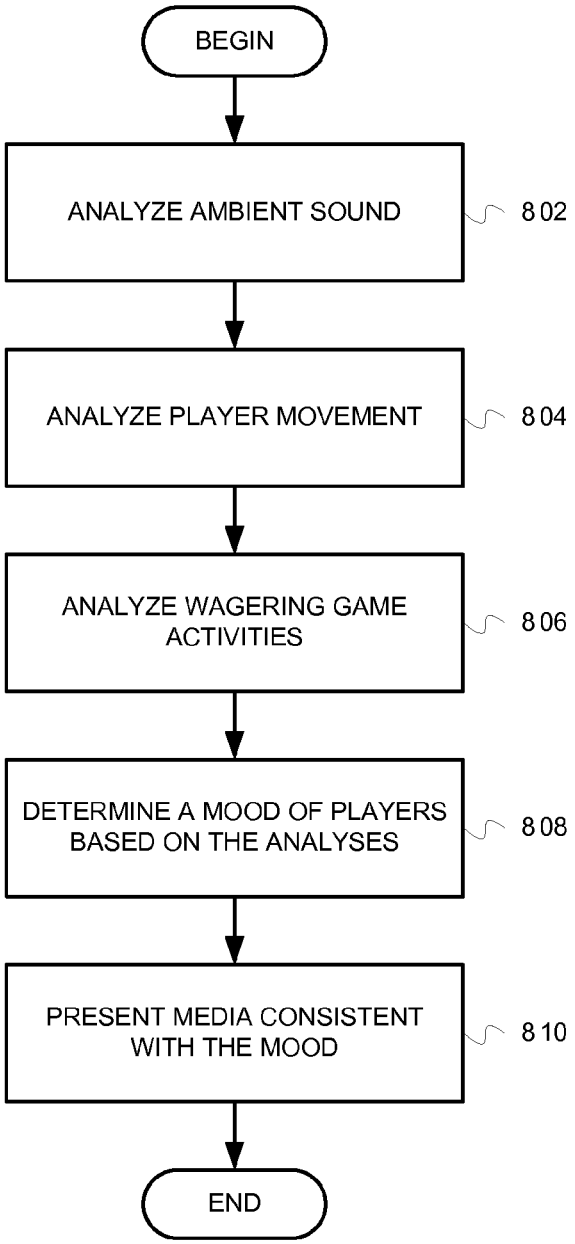
FIG. 8 is a flow diagram illustrating operations for using media to control moods in a wagering game environment, according to some embodiments of the invention.

FIG. 8 is a flow diagram illustrating operations for using media to control moods in a wagering game environment, according to some embodiments of the invention. The flow 800 begins at block 802.

At block 802, an environment server's mood controller analyzes ambient sound captured by microphones on a casino floor. In some embodiments, the mood controller can analyze the captured sound for volume, pitch, changes in volume, content (e.g., voice recognition), etc. The flow continues at block 804.

At block 804, the mood controller analyzes player movement about the casino. The mood controller can use computer vision technology to analyze video, and it can analyze information from motion sensors and other devices to determine how players are moving about a casino. The flow continues at block 806.

At block 806, the mood controller analyzes wagering game activities, such as wagering mounts, wager frequency, velocity of play, type of games played, etc. In some instances, the mood controller may also analyze account activities, such as deposits, withdrawals, transfers, etc. Thus, the mood controller can interact with any device on a wagering game network. The flow continues at block 808.

At block 808, the mood controller uses the audio analysis, movement analysis, and activity analysis to determine a mood of players in the casino. The mood controller can perceive a wide range of moods from energetic to mellow. If the audio volume is loud, player movements are rapid, and velocity of play is rapid, the mood controller may conclude that players are in an energetic mood. Conversely, if audio volume is low, player movements are slow, and velocity of play a slow, the mood controller may conclude that players are in a mellow mood. In some embodiments, the mood controller can identify numerous moods (e.g., moods in a plurality of zones) and can use other factors to determine those moods (e.g., external events such as sports scores, news events, etc.). The flow continues at block 810.

At block 810, the mood controller elicits a media presentation consistent with the mood. For example, the mood controller may select media consistent with the mood and direct the environment server's media controller to present the media. The media may include music, lighting, video, etc. The media can also include prerecorded or captured celebration associated with winning events. In some embodiments, the mood controller can detect different moods in different zones. In response, the environment server can present different media in each zone. In some embodiments, the mood controller can do more than just elicit media. For example, according to a mood, the mood controller can summon additional hospitality workers, adjust temperature, etc. Also, based on mood, the mood controller can elicit changes in denominations, betting limits, advertising, promotions, etc. on wagering game terminals.

Although block 810 describes presenting media consistent with a mood, some mood controllers can alter a mood by presenting media inconsistent with such a mood. In some embodiments, the mood controller may attempt to change a mellow mood into a high-energy mood by playing up-tempo music, increasing light strobe frequency, etc.

Figure 9:
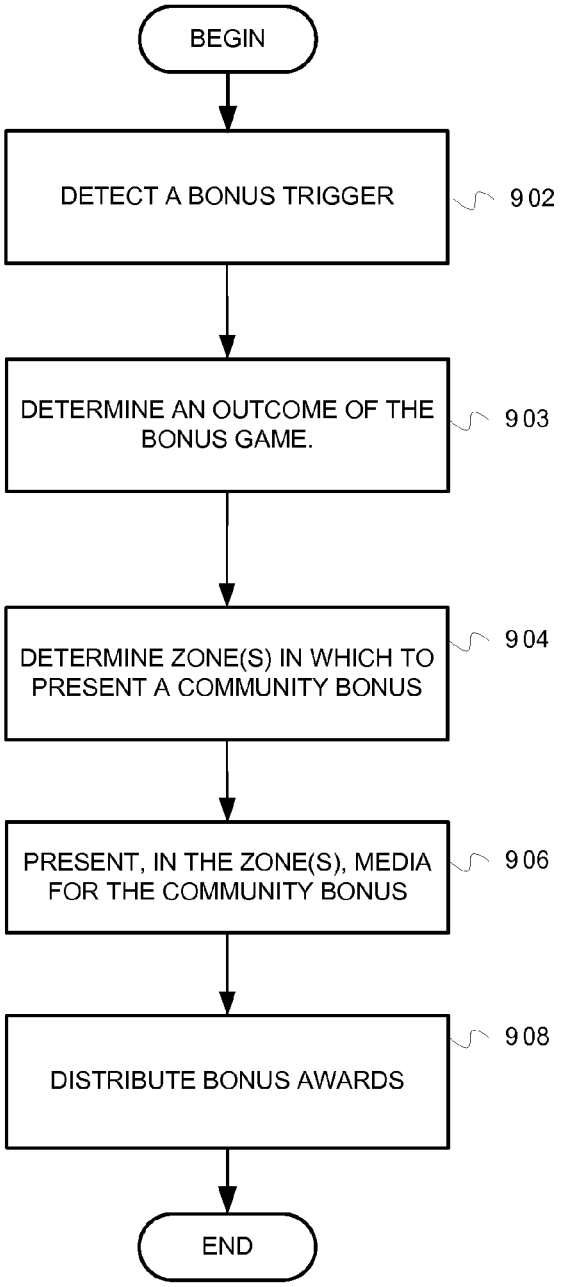
FIG. 9 is a flow diagram illustrating operations for presenting a community bonus game, according to some embodiments of the invention.

As noted above, embodiments of the server can present media associated with community bonus games. FIG. 9 is a flow diagram illustrating operations for presenting a community bonus game, according to some embodiments of the invention. The flow 900 begins at block 902.

At block 902, an environment server's bonus controller detects an event that triggers a bonus game. For example, the bonus controller may detect that a player on the casino floor is wearing a certain promotional shirt (e.g., by analyzing video captured on the casino floor). Alternatively, the trigger event can be related to activities in wagering games (e.g., players receive certain reel combinations in a slots game), moods on the casino floor, presence of a critical number of players in a social group (e.g., the environment server receives social group information from the community server and then finds members via player logins, face recognition, etc.), etc. The bonus game can involve a plurality of players (i.e., it can be a community bonus game). The flow continues at block 903.

At block 903, the bonus controller determines an outcome for the bonus game. In some embodiments, the outcome is based on a random number generated in the environment server or received from a wagering game server. The flow continues at block 904.

At block 904, the bonus controller determines zones in which to present media associated with the community bonus game. In some instances, bonus game media is limited to a particular zone, such as a zone designated as a VIP area. In other instances, bonus game media may be presented casino-wide. In some instances, the zone may be very small. For example, the zone may be limited to what a single player can see at a given wagering game terminal. The flow continues at block 906.

At block 906, the bonus controller elicits a media presentation in the selected zones. For example, the bonus controller can instruct the environment server's media controller to present a particular media in the selected zones. The flow continues at block 908.

At block 908, the bonus controller distributes awards. In some instances, the bonus controller can credit funds to one or more players' wagering game accounts or game session accounts. In some embodiments, the bonus controller augments player's game session accounts during a media presentation (e.g., as the bonus train passes a terminal, the terminal's credit meter is augmented by the award). The award may be nonmonetary, so the bonus controller may distribute the awards via other suitable ways, such as e-mail, crediting player accounts, etc. In some embodiments, the bonus controller can send awards to player profiles (e.g., the bonus controller can send a virtual trophy to a player's profile, so the trophy will appear in the player's online profile). From block 908, the flow ends.

More about Wagering Game Machines

In some of the embodiments discussed above, wagering games are conducted and presented using a wagering game server and terminals. However, in some embodiments, wagering game machines can present wagering games without assistance from wagering game servers. Moreover, according to some embodiments, the wagering game machines can interact with environment servers, player account servers, and community servers to perform the functions and operations discussed above.

Figure 10:
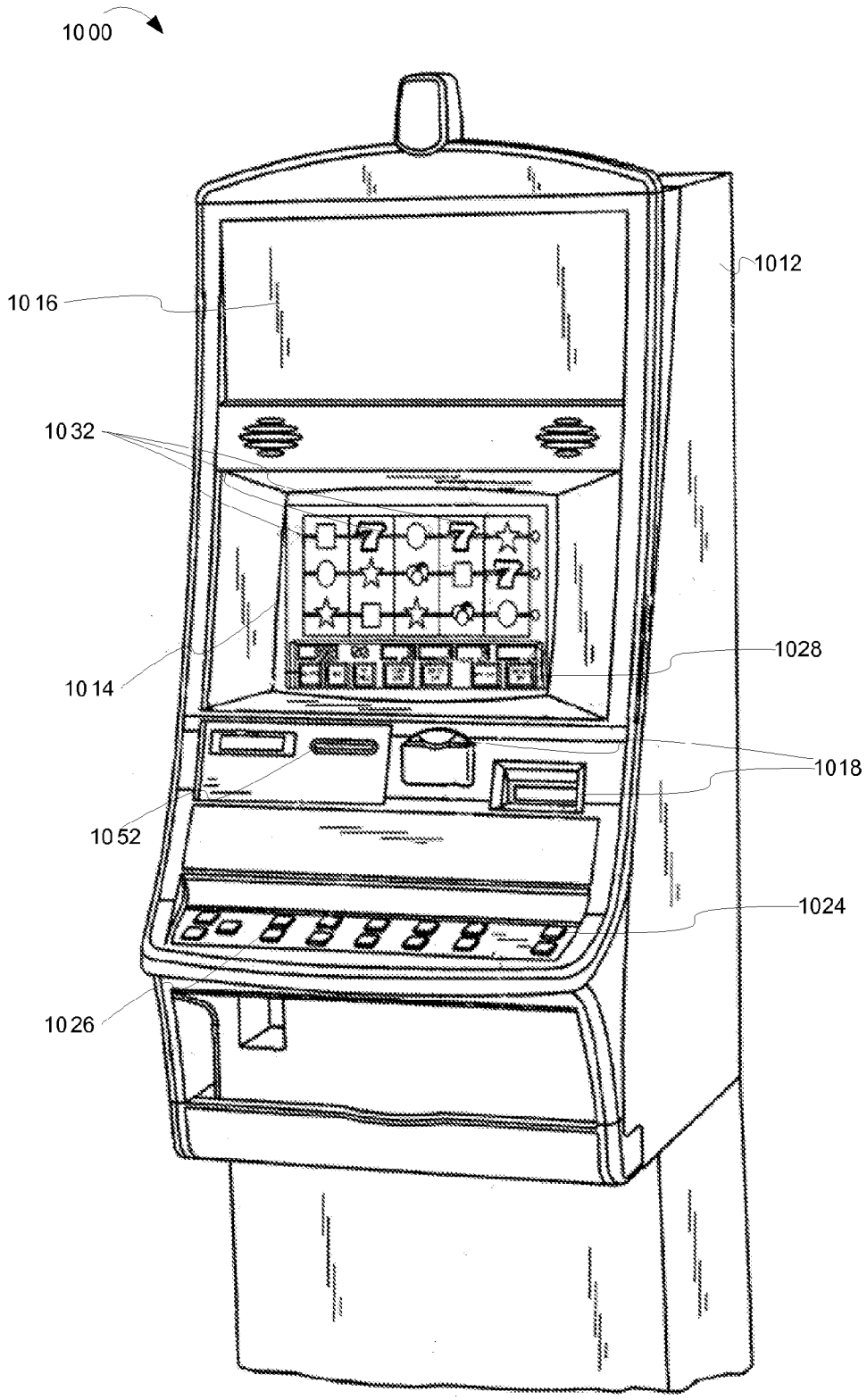
FIG. 10 is a perspective view of a wagering game machine, according to example embodiments of the invention.

FIG. 10 is a perspective view of a wagering game machine, according to example embodiments of the invention. Referring to FIG. 10, a wagering game machine 1000 is used in gaming establishments, such as casinos. According to embodiments, the wagering game machine 1000 can be any type of wagering game machine and can have varying structures and methods of operation. For example, the wagering game machine 1000 can be an electromechanical wagering game machine configured to play mechanical slots, or it can be an electronic wagering game machine configured to play video casino games, such as blackjack, slots, keno, poker, blackjack, roulette, etc.

The wagering game machine 1000 comprises a housing 1012 and includes input devices, including value input devices 1018 and a player input device 1024. For output, the wagering game machine 1000 includes a primary display 1014 for displaying information about a basic wagering game. The primary display 1014 can also display information about a bonus wagering game and a progressive wagering game. The wagering game machine 1000 also includes a secondary display 1016 for displaying wagering game events, wagering game outcomes, and/or signage information. While some components of the wagering game machine 1000 are described herein, numerous other elements can exist and can be used in any number or combination to create varying forms of the wagering game machine 1000.

The value input devices 1018 can take any suitable form and can be located on the front of the housing 1012. The value input devices 1018 can receive currency and/or credits inserted by a player. The value input devices 1018 can include coin acceptors for receiving coin currency and bill acceptors for receiving paper currency. Furthermore, the value input devices 1018 can include ticket readers or scanners for reading information stored on vouchers, cards, or other tangible portable storage devices. The vouchers or cards can authorize access to central accounts, which can transfer money to the wagering game machine 1000.

In some embodiments, the wagering game machine 1000 can also include an information reader 1052, which can include a card reader, ticket reader, bar code scanner, RFID transceiver, or computer readable storage medium interface. In some embodiments, the information reader 1052 can be used to award complimentary services, restore game assets, track player habits, etc. In some instances, the information reader accepts value (e.g., from debit media such as a debit card) for use in a wagering game environment (e.g., to place wagers, buy goods, etc.).

The player input device 1024 comprises a plurality of push buttons on a button panel 1026 for operating the wagering game machine 1000. In addition, or alternatively, the player input device 1024 can comprise a touch screen 1028 mounted over the primary display 1014 and/or secondary display 1016.

The various components of the wagering game machine 1000 can be connected directly to, or contained within, the housing 1012. Alternatively, some of the wagering game machine's components can be located outside of the housing 1012, while being communicatively coupled with the wagering game machine 1000 using any suitable wired or wireless communication technology.

The operation of the basic wagering game can be displayed to the player on the primary display 1014. The primary display 1014 can also display a bonus game associated with the basic wagering game. The primary display 1014 can include a cathode ray tube (CRT), a high resolution liquid crystal display (LCD), a plasma display, light emitting diodes (LEDs), or any other type of display suitable for use in the wagering game machine 1000. Alternatively, the primary display 1014 can include a number of mechanical reels to display the outcome. In FIG. 10, the wagering game machine 1000 is an "upright" version in which the primary display 1014 is oriented vertically relative to the player. Alternatively, the wagering game machine can be a "slant-top" version in which the primary display 1014 is slanted at about a thirty-degree angle toward the player of the wagering game machine 1000. In yet another embodiment, the wagering game machine 1000 can exhibit any suitable form factor, such as a free standing model, bartop model, mobile handheld model, or workstation console model.

A player begins playing a basic wagering game by making a wager via the value input device 1018. The player can initiate play by using the player input device's buttons or touch screen 1028. The basic game can include arranging a plurality of symbols along a payline 1032, which indicates one or more outcomes of the basic game. Such outcomes can be randomly selected in response to player input. At least one of the outcomes, which can include any variation or combination of symbols, can trigger a bonus game.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A system to present a wagering game in a wagering game environment, the system comprising:

a plurality of wagering game machines configured to present wagering games;

an account server configured to manage player accounts that provide monetary value for use in the wagering games;

a microphone configured to capture sound associated with player activity in the wagering game environment;

a camera configured to capture video indicating the player activity in the wagering game environment;

an environment server configured to determine zones in the wagering game environment; receive one or more recordings including the sound and the video; determine, based on the one or more recordings, a trigger condition has been met for presenting mood-altering video content and mood-altering audio content in one or more of the zones in the wagering game environment;

control presentation of the mood-altering video content; and control presentation of the mood-altering audio content;

one or more video projectors configured to project the mood-altering video content onto one or more reflective surfaces in the one or more of the zones, wherein the reflective surfaces are positioned so the mood-altering video content is not perceptible to players outside of the one or more of the zones; and one or more audio presentation devices configured to present the mood-altering audio content in the one or more of the zones.

2. The system of claim 1, wherein the environment server is further configured to determine a mood of the players in one or more of the zones of the wagering game environment based on the audio and video.

3. The system of claim 1, wherein the environment server is further configured to select, based on the one or more recordings, a community bonus game from a plurality of community bonus games.

4. The system of claim 1, wherein the environment server is further configured to select the one or more of the zones in which the mood-altering audio content and mood-altering video content will be presented.

5. The system of claim 1, wherein the environment server is further configured to control presentation of lighting content associated with presenting the mood-altering video content and mood-altering audio content, and wherein the system further comprising one or more lighting devices configured to present the lighting content.

6. The system of claim 1, wherein the one or more of the zones is determined based on being in a contiguous floor area in the wagering game environment.

7. The system of claim 1, wherein the one or more of the zones is determined based on being in a contiguous floor area in the wagering game environment.

8. The system of claim 1, wherein content of the wagering games is modified based on the trigger condition.

9. A method for presenting a community bonus game in a casino, the method comprising:

determining zones associated with geographic areas in the casino capturing, via a microphone, sound in the casino;

capturing, via a camera, video in the casino;

determining, based on the video and the sound, player activities in the casino;

determining that one or more of the player activities in the casino has met a trigger condition for a community bonus game involving a plurality of players in the one or more of the zones in the casino;

projecting, via a video projector, video content representing the community bonus game onto projection screens in the one or more of the zones in the casino, wherein the projection screens include reflective material positioned so that projected video content is not perceptible to players outside the one or more of the zones; and presenting audio content representing the community bonus game via audio speakers in the one or more of the zones in the casino, wherein the presented audio content is not perceptible to the players outside of the one or more of the zones.

10. The method of claim 9 further comprising:

determining lighting content associated with the community bonus game, and presenting the lighting content by adjusting pivoting lights to illuminate the one or more of the zones in the casino, and selecting intensity of light emanating from the pivoting lights.

11. The method of claim 9, wherein the sound and the video are captured from the one or more of the zones, and wherein speakers and projection screens are located in the one or more of the zones.

12. The method of claim 9, wherein the determining that one or more of the player activities in the casino has met a trigger condition is based on determining a mood of the plurality of players in the one or more of the zones in the casino.

13. A non-transitory machine-readable medium which when executed by a machine causes the machine to execute instructions comprising:

instructions to determine zones associated with geographic areas in a casino;

instructions to capture sound and images in at least one of the zones, wherein the sound and images indicate player activities in the at least one of the zones;

instructions to determine, based on the player activities, that a trigger condition for a community bonus game has been met, wherein the community bonus game involves a plurality of players in the at least one of the zones;

instructions to determine a result for the community bonus game;

instructions to present the media representing the result of the community bonus game on media devices in the at least one of the zones, wherein the instructions to present the media include instructions to project video images onto reflective material positioned so the images are not perceptible to players outside the at least one of the zones; and instructions to present audio representing the result of the community bonus game over speakers configured so the audio is not perceptible to the players outside the at least one of the zones.

14. The non-transitory machine-readable medium of claim 13 further comprising:

instructions to request hospitality services for the at least one of the zones.

15. The non-transitory machine-readable medium of claim 13, wherein the reflective material includes triangular shapes, and wherein the reflective material is suspended from a ceiling of the casino.

16. The non-transitory machine-readable medium of claim 13, wherein the trigger condition is based on a mood of the plurality of players in the at least one of the zones.

17. The non-transitory machine-readable medium of claim 16, further comprising: instructions to determine the mood of players in the wagering game environment based on the captured sound and images in the at least one of the zones.

18. The non-transitory machine-readable medium of claim 13, further comprising: instructions to determine zones in the wagering game environment, and select one or more of the zones in which the audio content and video content will be presented.

* * * * *